United States Patent [19]

Ohno et al.

[11] Patent Number: 4,656,830

[45] Date of Patent: Apr. 14, 1987

[54] EXHAUST MANIFOLD FOR INTERNAL COMBUSTION ENGINES

[75] Inventors: Hiromitsu Ohno, Sakado; Yutaka Noritake, Kawagoe; Kimimasa Owari, Toda; Masuo Fukuda, Ohmiya, all of Japan

[73] Assignee: Honda Giken Kogyo Kabushiki Kaisha, Tokyo, Japan

[21] Appl. No.: 863,019

[22] Filed: May 14, 1986

[30] Foreign Application Priority Data

May 14, 1985 [JP] Japan ..... 60-103567

[51] Int. Cl.[4] ..... F01N 3/18

[52] U.S. Cl. ..... 60/276; 60/323

[58] Field of Search ..... 60/276, 313, 323

[56] References Cited

U.S. PATENT DOCUMENTS 4,484,440 11/1984 Oki ..... 60/276

FOREIGN PATENT DOCUMENTS 2725944 12/1978 Fed. Rep. of Germany ..... 60/276

*Primary Examiner*—Douglas Hart

*Attorney, Agent, or Firm*—Lyon & Lyon

[57] ABSTRACT

An exhaust manifold for an internal combustion engine wherein exhaust ducts connected to respective engine cylinders are formed of discrete pipe members. A united section has an upstream divergent portion connected to the exhaust ducts and a downstream convergent portion to exhaust pipes. An internal space is defined in the downstream convergent portion and located intermediately between adjacent internal passages in the downstream convergent portion to communicate them with each other. An opening is formed in the peripheral wall of the downstream convergent portion at a location positionally corresponding to the internal space. A flange member has a boss formed thereon and being larger in size than the opening and disposed in face-to-face contact with an outer surface of the peripheral wall of the downstream convergent portion. The boss has a through bore formed therein and aligned with the opening, through which an exhaust constituent concentration sensor is to be inserted.

6 Claims, 5 Drawing Figures

EXHAUST MANIFOLD FOR INTERNAL COMBUSTION ENGINES

BACKGROUND OF THE INVENTION

This invention relates to an exhaust manifold for internal combustion engines and, more particularly, to an exhaust manifold in which exhaust ducts for guiding exhaust gases to the exhaust pipe or exhaust pipes are formed of discrete pipe members.

Exhaust manifolds for internal combustion engines are comprised of a plurality of exhaust ducts having exhaust conduits defined therein and connected to respective cylinders of the engine, and at least one united section in which exhaust gases flowing through the exhaust ducts are gathered together. Conventional exhaust manifolds of this kind are generally formed of castings such as iron casting in which the exhaust ducts and the united section are integrally formed in a one-piece body. Also flanges provided at upstream ends of the respective exhaust ducts for connection with the cylinder head as well as a flange provided at a downstream end of the united section for connection with the exhaust pipe or exhaust pipes are formed integrally with the exhaust ducts and the united section, respectively.

Problems encountered with such conventional exhaust manifolds formed of castings are that it is difficult to reduce the weight, and it is also difficult to obtain desired smoothness of inner wall surfaces of the exhaust conduits and equality in cross-sectional area between the exhaust ducts, involving the disadvantage that exhaust gases cannot be smoothly discharged through the exhaust manifold. In order to solve the problems with the conventional exhaust manifolds made of castings, exhaust manifolds of a so-called pipe structure have lately been employed in which the exhaust ducts are formed of discrete pipe members.

A typical example of the conventional exhaust manifolds made of discrete pipe members is shown in FIG. 1, wherein the exhaust manifold comprises four exhaust ducts 1–4 formed of discrete pipe members, united tubes 5, 5' constituting a united section connected with respective pairs of the exhaust ducts 1–4 at downstream ends thereof, a flange member 6 formed with a plurality of integral flanges for connection with a cylinder head, not shown, and a flange 7 for connection with the united tubes 5, 5', all the component parts being fabricated in separate bodies from each other and joined together by means of welding or the like. The united tubes 5, 5' are generally formed of sheet metal or a like material and have their ends fitted on downstream ends of the exhaust ducts 1–4 connected to respective engine cylinders, not shown, and welded thereto. The flanges 6, 7 are formed of castings or forgings.

The illustrated exhaust manifold is adapted for use in a four-cylinder internal combustion engine, and is of a so-called "dual exhaust manifold structure" which is so configurated that each of the united tubes 5, 5' is to be connected with engine cylinders which are so located relative to each other that the exhaust stroke of one of the cylinders does not take place immediately after that of the other cylinder, so as to avoid interference of exhaust discharge with each other.

Exhaust manifolds, if used in electronically controlled internal combustion engines in which the air-fuel ratio of a mixture supplied to the engine is electronically controlled in response to operating conditions of the engine, etc. have to be adapted for installation of an exhaust constituent-concentration sensor such as an $O_2$ sensor therein for sensing the concentration of an exhaust constituent such as oxygen in the exhaust gases emitted from the engine to detect the actual air-fuel ratio of the mixture.

However, the aforesaid conventional exhaust manifolds of the pipe structure are not structurally suited for the installation of $O_2$ sensor therein. That is, in the case of providing $O_2$ sensors respectively in the exhaust ducts of an exhaust manifold of this type it is necessary to form a bore in each exhaust duct through which a sensing probe of an $O_2$ sensor is to be inserted and also to weld a separately fabricated boss plate formed therein with a sensor-fitting hole to a portion of the exhaust duct formed with the above bore. In the case of providing $O_2$ sensors in the united section, although so many $O_2$ sensors are not required to be used as in the former case, the $O_2$ sensors will be located at lower temperature downstream portions of the manifold which are unfavorable to activation of the sensors, and it is necessary to form a bore in the united section through which a sensing probe of an $O_2$ sensor is to be inserted and also to weld a separately fabricated boss plate formed therein with a sensor-fitting hole to a portion of the exhaust duct formed with the above bore, as in the former case. Therefore, in either case, the number of component parts is necessarily large, the fitting operation of the $O_2$ sensors is difficult and complicated, and in the dual exhaust manifold in particular, in which all the united tubes for all the cylinders are located at a downstream side of the manifold, there is a limitation in the location at which the sensors are to be mounted in the manifold.

SUMMARY OF THE INVENTION

It is therefore the object of the invention to provide an exhaust manifold for internal combustion engines, which is so constructed as to facilitate the installation of $O_2$ sensors therein at the united section.

The present invention provides an exhaust manifold for an internal combustion engine having a plurality of cylinders and at least one exhaust pipe, comprising: a plurality of exhaust ducts formed of discrete pipe members, the exhaust ducts having respective exhaust conduits defined therein and connected at upstream ends thereof to respective ones of the cylinders; a united section having an upstream divergent portion connected to downstream ends of the exhaust ducts and having a downstream convergent portion having at least two internal passages defined therein; and a flange member coupled with the downstream convergent portion of the united section for connecting the united section to the at least one exhaust pipe.

The invention provides an improvement in the above exhaust manifold structure, wherein: (a) an internal space is defined in the downstream convergent portion of the united section at a location intermediate between adjacent ones of the at least two internal passages to communicate them with each other; (b) an opening is formed in the peripheral wall of the downstream convergent portion at a location positionally corresponding to the internal space; and (c) the flange member has a boss formed thereon, the boss being larger in size than the opening and disposed in face-to-face contact with an outer surface of the peripheral wall of the downstream convergent portion, the boss having a through bore formed therein and aligned with the opening, through which an exhaust constituent concentration sensor is to be inserted.

The above and other objects, features, and advantages of the invention will be more apparent from the ensuing detailed description taken in conjunction with the accompanying drawings.

DETAILED DESCRIPTION

Figure 1:
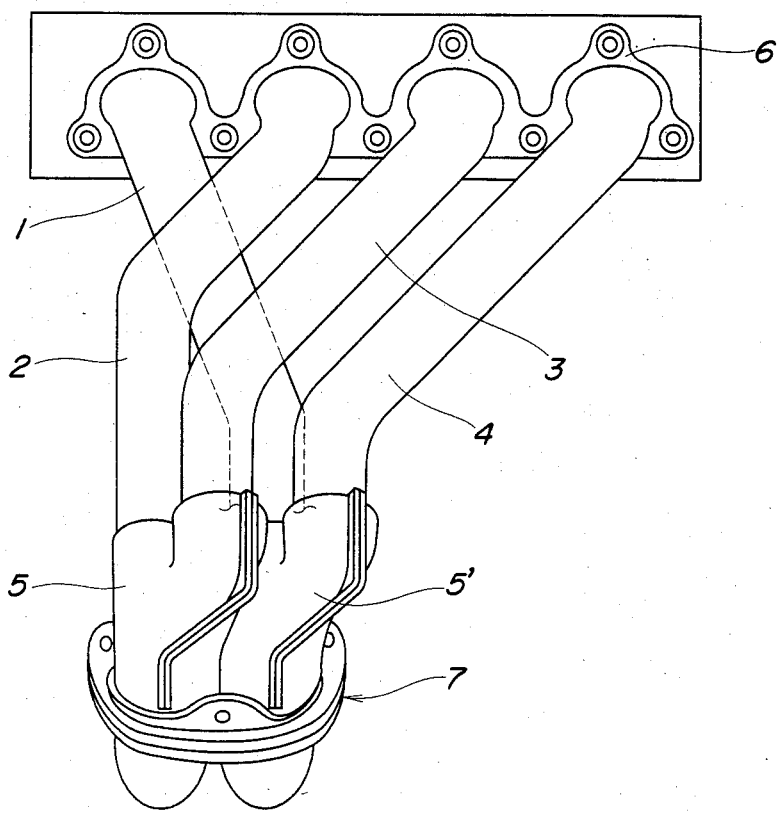
FIG. 1 is a front elevational view of a conventional exhaust manifold of the pipe structure for an internal combustion engine.
Figure 2:
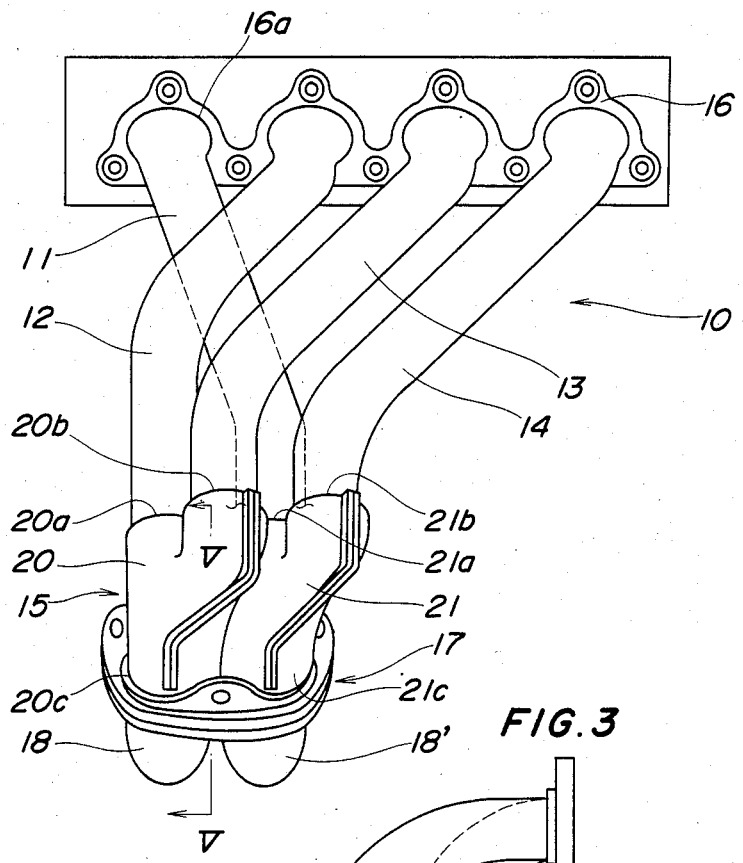
FIG. 2 is an exhaust manifold for an internal combustion engine according to an embodiment of the present invention.
Figure 3:
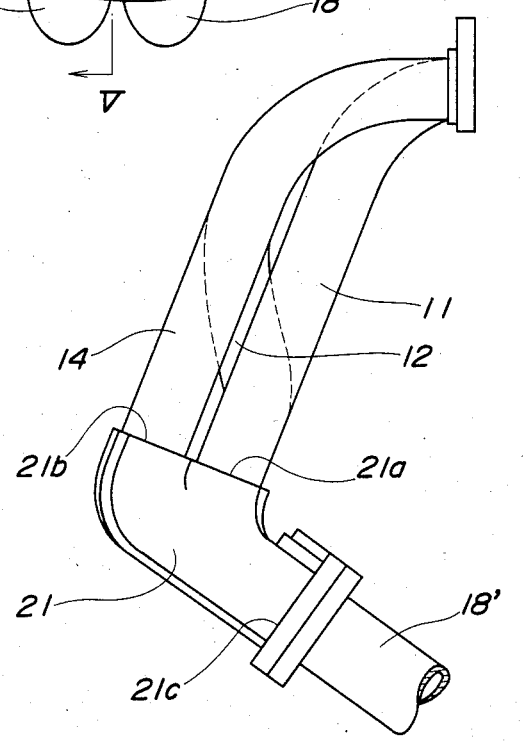
FIG. 3 is a side view of the exhaust manifold shown in FIG. 2.

An embodiment of the exhaust manifold according to the invention will now be described in detail with reference to the drawings.

Referring first to FIGS. 2-5, an exhaust manifold 10 according to the invention is comprised of a plurality of, e.g. four, exhaust ducts 11-14, each having defined therein an exhaust conduit, not shown, and connected at upstream ends thereof to respective ones of engine cylinders, not shown. The exhaust ducts 11-14 are formed of discrete pipe members like conventional exhaust ducts. A united section 15 is connected at an upstream end thereof to downstream ends of the exhaust ducts 11-14. A flange member 16 for connection with a cylinder head, which is formed with four through bores 16*a*, is attached to the upstream ends of the exhaust ducts 11-14 for connecting the exhaust ducts 11-14 with exhaust ports, not shown, of the respective engine cylinders. Another flange member 17 is coupled with the downstream end of the united section 15 for connecting the united section to exhaust pipes 18, 18'.

The united section 15 has two united tubes 20, 21, each of which has its upstream divergent half of a dual cylindrical shape formed therein with two holes 20*a*, 20*b*; 21*a*, 21*b*, in which are securedly fitted downstream ends of corresponding exhaust ducts 12, 13; and 11, 14, each paired exhaust ducts being connected with engine cylinders which are so arranged that the exhaust stroke of one of the cylinders does not take place immediately following that of the other cylinder.

Figure 4:
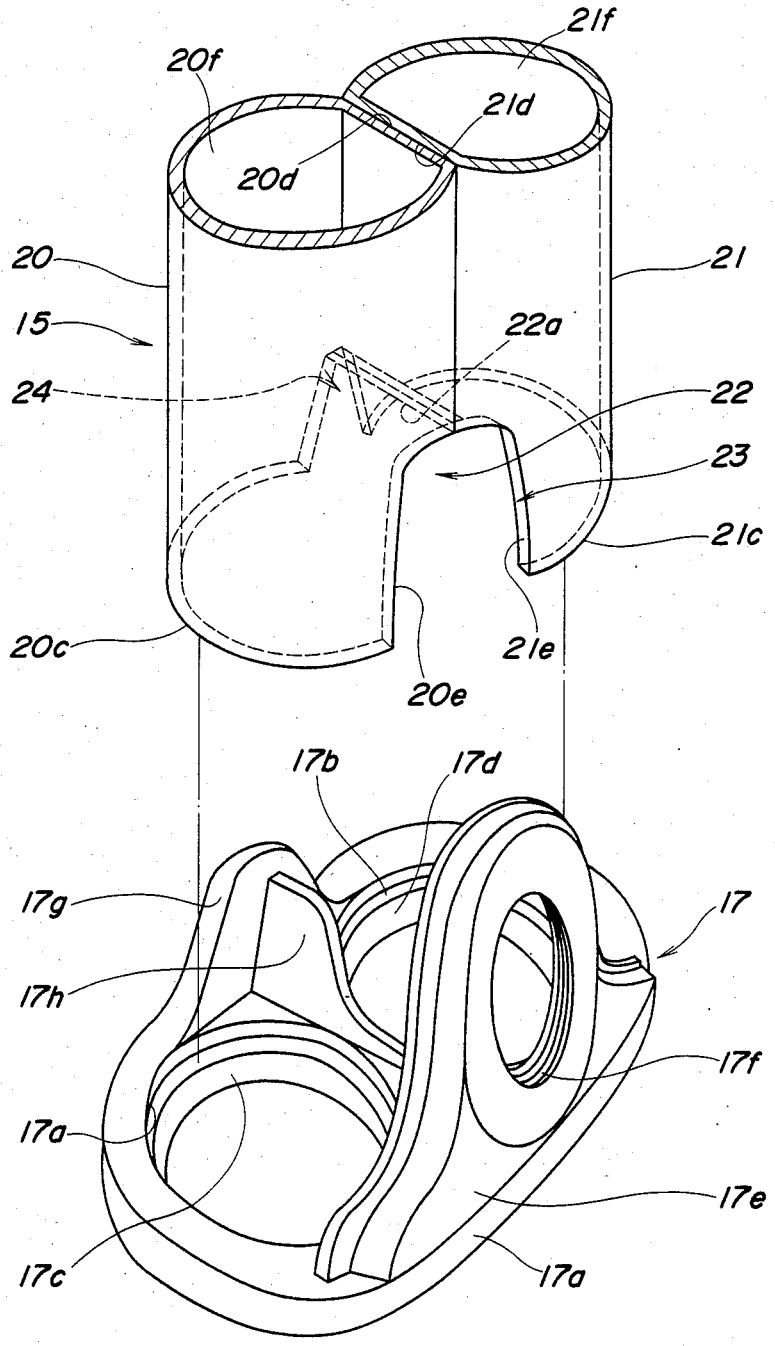
FIG. 4 is a perspective view of a united section and a flange member for mating therewith, both appearing in FIG. 2.

Each of the united tubes 20, 21 has a downstream convergent half of a single cylindrical shape toward the downstream end 20*c*, 21*c* so that only one internal passage 20*f*, 21*f* is defined within the downstream convergent half and continuous with the holes 20*a*, 20*b*; 21*a*, 21*b*, respectively, providing the whole united tube with a generally y-shaped configuration. The downstream convergent halves of the united tubes 20, 21 are configurated as shown in FIG. 4. The downstream convergent halves of the united tubes 20, 21 have their side walls 20*d*, 21*d* longitudinally abutting against each other and secured together by means of welding or the like. The abutting side walls 20*d*, 21*d* have their downstream end edges cut out to form a recess 22*a* opening in the open downstream end faces of the united tubes, to define an internal space 22, hereinafter referred to. Further, adjacent portions of the peripheral walls of the united tubes 20, 21 have their downstream end edges cut out to form notches 20*e*, 21*e* defining in combination an opening 23 through which a sensing probe of an $O_2$ sensor is to be inserted. Also, further adjacent portions of the peripheral walls at the opposite side have their downstream end edges similarly cut out or notched to form in combination another opening 24.

The flange member 17 for connection with the exhaust pipes 18, 18' is formed of a one-piece casting and comprises an oblong flange-forming base plate 17*a* formed therein with shallow fitting holes 17*a*, 17*b* into which downstream ends 20*c*, 21*c* of the united tubes 20, 21 of the united section 15 are to be securedly fitted, respectively, and also with communication holes 17*c*, 17*d* concentric with the respective fitting holes 17*a*, 17*b* and slightly smaller in diameter than the fitting holes 17*a*, 17*b*, for communicating with the respective exhaust pipes 18, 18'. The base plate 17*a* is formed integrally with a first boss 17*e* larger in size than the aforesaid opening 23 in the united section 15, erected on or extending at right angles to a lateral side edge of the base plate at a location positionally corresponding to the opening 23. The first boss has a sensor-fitting tapped hole 17*f* formed therein at a central portion thereof for mounting a sensor such as the $O_2$ sensor therethrough. The base plate 17*a* is formed integrally with a second boss 17*g* larger in size than the opening 24 in the united section 15, extending at right angles to the opposite side edge of the base plate 17*a* at a location positionally corresponding to the opening 24. Further, a partition wall 17*h* is erected integrally on the base plate at a location positionally corresponding to the recess 22*a*, extending transversely of the base plate from the second boss 17*g* toward the first boss 17*e* with its profile designed to fit the profile of the sensing probe of the sensor.

Figure 5:
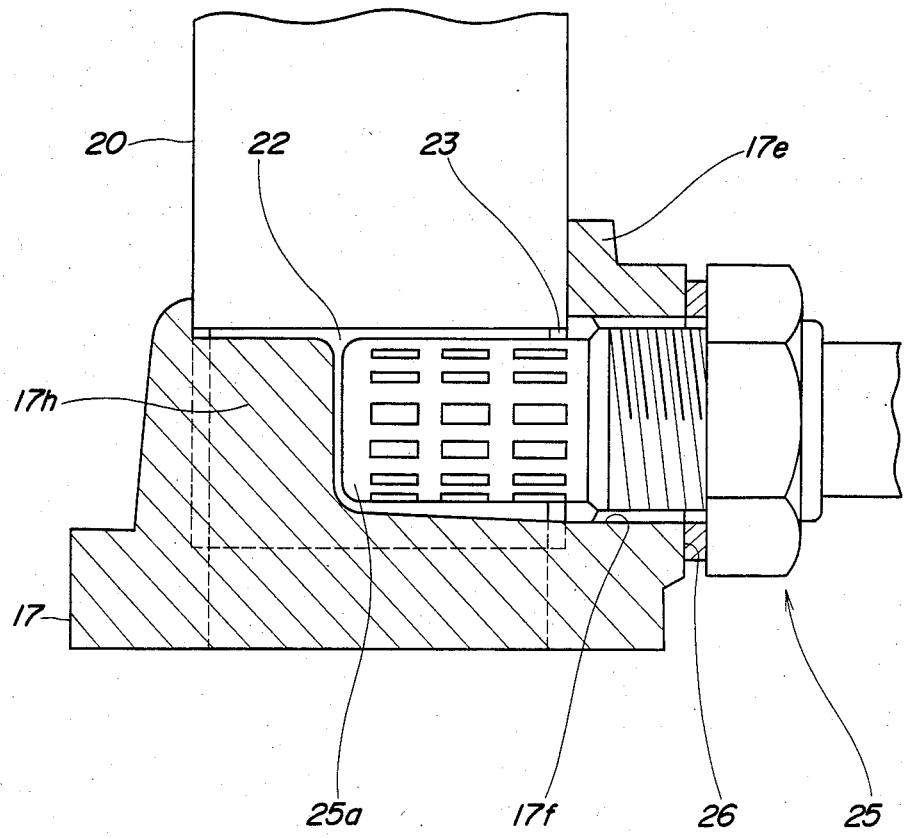
FIG. 5 is a sectional view taken along line V—V in FIG. 2.

To put the flange member 17 and the united section 15 together, the downstream ends 20*c*, 21*c* of the united tubes 20, 21 of the united section 15 are fitted into the respective fitting holes 17*a*, 17*b* in the flange member 17 in such a manner that the bosses 17*e*, 17*g* are brought into face-to-face contact with outer surfaces of the respective adjacent portions of the peripheral walls of the united tubes 20, 21 at the opposite sides of the flange member 17 to cover the respective openings 23, 24 in the united tubes 20, 21. Then, the bosses 17*e*, 17*g* are welded to the outer surfaces of the united tubes 20, 21. By this construction as shown in FIG. 5, part of the internal space 22 is occupied by the partition wall 17*h* which is then fitted in the opening 24 to separate the two internal passages 20*f*, 21*f* in the downstream united tube portions from each other.

To mount an exhaust constituent concentration sensor, such as an $O_2$ sensor, in the united section, the sensing probe 25*a* of the $O_2$ sensor 25 is inserted into the internal space 22 defined by the recess 22*a* through the tapped hole 17*f* formed in the boss 17*e*, and then the sensor body is screwed into the tapped hole 17*f* whereby the $O_2$ sensor is brought into threaded engagement with the flange member 17. With the $O_2$ sensor thus mounted in the united section, the sensing probe 25*a* of the $O_2$ sensor is located in the internal space 22 defined by the recess 22*a*, with its opposite lateral side faces exposed to the respective internal passages 20*f*, 21*f* in the united tubes 20, 21, and also with the tip of the sensing probe 25*a* disposed opposite an associated side edge surface of the partition wall 17*h* through a small gap. The presence of the partition wall 17*h* effectively minimizes the exhaust discharge interference between the two internal passages 20*f*, 21*f*. Further, the integral formation of the partition wall 17*h* with the flange member 17 facilitates molding of the flange member 17 formed with the two bosses 17*e*, 17*g*, and also simplifies the design of the united tubes 20, 21 to facilitate machining of the pipe members.

The other end face of the flange member 17 opposite to the end face on which the bosses 17*e*, 17*g* are formed is to be abutted against flanged end faces of the respective exhaust pipes 18, 18' to communicate the internal passages 20*f*, 21*f* with the interior of the exhaust pipes 18, 18'.

Exhaust gases emitted from the cylinders of the engine are guided through the respective exhaust ducts 11–14, the united section 15, and the flange member 17 into the exhaust pipes 18, 18'. The $O_2$ sensor 25 located in the internal space 22 senses the concentration of oxygen in the exhaust gases emitted from all the engine cylinders and flowing in the internal passages 20*f*, 21*f*.

The partition wall 17*h* as used in the illustrated embodiment may be omitted or changed in shape and/or size in conformity to the shape and size of the sensor provided in the internal space 22.

What is claimed is:

1. In an exhaust manifold for an internal combustion engine having a plurality of cylinders and at least one exhaust pipe, comprising: a plurality of exhaust ducts formed of discrete pipe members, said exhaust ducts having respective exhaust conduits defined therein and connected at upstream ends thereof to respective ones of the cylinders; a united section having an upstream divergent portion connected to downstream ends of the exhaust ducts and having a downstream convergent portion having at least two internal passages defined therein and a peripheral wall; and a flange member coupled with the downstream convergent portion of the united section for connecting the united section to the at least one exhaust pipe, the improvement wherein: (a) an internal space is defined in the downstream convergent portion of the united section and at a location intermediate between adjacent ones of the at least two internal passages to communicate them with each other; (b) an opening is formed in the peripheral wall of the downstream convergent portion at a location positionally corresponding to the internal space; and (c) the flange member has a boss formed thereon, said boss being larger in size than the opening and disposed in face-to-face contact with an outer surface of the peripheral wall of the downstream convergent portion, the boss having a through bore formed therein and aligned with the opening, through which an exhaust constituent concentration sensor is to be inserted.

2. The exhaust manifold as defined in claim 1, wherein said united section has at least one pair of united tubes each having an upstream divergent half having at least two holes defined therein and a downstream convergent half having one internal passage defined therein and continuous with the at least two holes in the upstream divergent half, the downstream convergent halves of the united tubes having side walls thereof longitudinally abutting against each other and secured together, the abutting side walls having downstream end edges cut out to form a recess opening in downstream end faces of the united tubes, to define said internal space.

3. The exhaust manifold as defined in claim 2, wherein the united tubes have peripheral walls, adjacent portions of which have downstream end edges cut out to form notches defining in combination said opening.

4. The exhaust manifold as defined in claim 1, wherein the flange member has a second boss formed thereon and disposed opposite the first boss, and a partition wall formed thereon at a location positionally corresponding to said internal space, and extending from the second boss toward the first boss.

5. The exhaust manifold as defined in claim 4, wherein a second opening is formed in the periphera) wall of the downstream convergent portion of the united section at a location opposite said first-mentioned opening, said partition wall being fitted in said second opening.

6. The exhaust manifold as defined in claim 5, wherein the second boss is larger in size than the second opening, and is disposed in face-to-face contact of an outer surface of the peripheral wall of the downstream convergent portion to cover the second opening.

* * * * *

UNITED STATES PATENT AND TRADEMARK OFFICE

CERTIFICATE OF CORRECTION

PATENT NO. : 4,656,830

DATED : April 14, 1987

INVENTOR(S) : Ohno et al.

It is certified that error appears in the above-identified patent and that said Letters Patent is hereby corrected as shown below:

Title page: Item (73) co-assignee should read

--Sankei Giken Kogyo Kabushiki Kaisha--

Signed and Sealed this

Twenty-eighth Day of April, 1992

*Attest:*

HARRY F. MANBECK, JR.

*Attesting Officer*

*Commissioner of Patents and Trademarks*